US010139167B1

(12) United States Patent
Courson

(10) Patent No.: US 10,139,167 B1
(45) Date of Patent: Nov. 27, 2018

(54) HEAT EXCHANGER

(71) Applicant: Michael W. Courson, Alpine, CA (US)

(72) Inventor: Michael W. Courson, Alpine, CA (US)

( * ) Notice: Subject to any disclaimer, the term of this patent is extended or adjusted under 35 U.S.C. 154(b) by 0 days.

(21) Appl. No.: 15/982,388

(22) Filed: May 17, 2018

(51) Int. Cl.

| | |
|---|---|
| ***F28D 7/00*** | (2006.01) |
| ***F28F 1/02*** | (2006.01) |
| ***F02M 26/32*** | (2016.01) |
| ***F28D 7/10*** | (2006.01) |

(52) U.S. Cl.
CPC ..... *F28D 7/0025* (2013.01); *F02M 26/32* (2016.02); *F28D 7/106* (2013.01); *F28F 1/022* (2013.01)

(58) Field of Classification Search
CPC ..... F28D 7/0025; F28D 7/106; F28D 7/00; F28D 9/00; F28D 7/0066; F28D 7/022; F28D 7/103; F02M 26/32; F28F 1/022; F28F 3/005; F28F 3/08
USPC ..... 165/164, 141, DIG. 141, DIG. 160, 165/DIG. 34
See application file for complete search history.

(56) References Cited

U.S. PATENT DOCUMENTS

| | | | | |
|---|---|---|---|---|
| 3,584,682 | A * | 6/1971 | Leedham | B21D 53/02 165/164 |
| 3,735,810 | A * | 5/1973 | Ostbo | F24H 1/28 165/142 |
| 3,831,377 | A * | 8/1974 | Morin | F01N 3/02 55/DIG. 30 |
| 3,848,661 | A * | 11/1974 | Palm | F24H 1/24 165/155 |
| 4,089,370 | A * | 5/1978 | Marchal | F28D 7/103 165/159 |
| 4,355,684 | A * | 10/1982 | Caines | F28F 19/00 165/154 |
| 8,721,981 | B2 * | 5/2014 | Freund | F28D 9/04 165/164 |
| 2007/0071663 | A1 * | 3/2007 | Lee | B01J 8/0214 422/202 |

* cited by examiner

*Primary Examiner* — Justin Jonaitis
(74) *Attorney, Agent, or Firm* — Donn K. Harms

(57) ABSTRACT

A fluid heat exchanger having an interior cavity of a housing. A tank positioned within the interior cavity has a first wall surrounding an axial passage and a second wall surrounded by a circumferential passage. Heat is transferred to both the first wall and surrounding second wall thereby heating fluid in the tank from opposing sides. The heat transfer is enhanced with a cyclonic flow of heated fluid in the circumferential passage and axial passage.

16 Claims, 3 Drawing Sheets

HEAT EXCHANGER

FIELD OF THE INVENTION

The disclosed device and method herein relate generally to heat exchangers employed to communicate heat from a heat source to a liquid. More particularly, it relates to a heat exchanger which is configured with heat transferring contact surfaces on both sides of a liquid tank, and which is further enhanced by one or a plurality of fluid flow directors which direct the flow of heated fluid or air around and against the contact surfaces for increased efficiency.

BACKGROUND OF THE INVENTION

A heat exchanger is a device which is configured in operation to transfer heat between a solid object and a fluid, or between two or more fluids. Such fluids, for example, may include heated air from an engine exhaust or other heat source or a heated liquid. In operation in a heat exchanger component, the fluids are conventionally separated by a solid wall to prevent mixing, but allow the transfer of heat between the two liquids.

The most widely used heat exchanger is a single-phase heat exchanger. In operation of such single-phase heat exchangers, both the heated fluid and a cooler fluid flowing through the heat exchanger remain in their initial gaseous or liquid states. In the conventional operation of such single-phase heat exchangers, conventionally two fluids flow through separated flow paths at different temperatures and are separated by a conducting medium such as metal ceramic or in some cases polymeric materials. A widely employed single phase heat exchanger design provides such separated flowpaths for a first fluid flowing through the interior passage of one or a plurality of metal tubes, and for the second fluid flowing around the exterior surfaces of those tubes. On either side of the tube, heat from one fluid is transferred to the other by convection. This heat from the hotter fluid to the lower temperature fluid is transferred through the tube wall by conduction.

Conventional single-phase heat exchangers conventionally employ a shell which surrounds one or a plurality of tubes situated within the shell. At the ends of the heat exchanger, the fluid flowing into and out of the tube is separated from the second fluid located between the interior wall of the shell and the tube by a separating sheet of conductive material forming the surrounded tube.

However, this conventional design of a shell having the second fluid therein which surrounds the exterior of the tube positioned within the shell wall limits the area of the contact surfaces to communicate heat between the two fluids and to the exterior of the material forming the tube.

The device herein provides a heat exchanger which includes not one but two heat transfer surfaces for heat transfer by convection, from the hotter fluid to the cooler fluid. Additionally, the device herein includes a first fluid flow director which imparts a first cyclonic flow as well as a second flow director which intersects with the incoming first cyclonic fluid flow once it has communicated around a circular sidewall surface as the fluid flows around a chamber surrounded by a wall surface of a chamber holding a second fluid. This second fluid flow director induces a second cyclonic fluid flow to the entering first fluid causing an enhanced circular flow for a longer contact time around an exterior and around an interior surface of the tube surrounding the second fluid.

Thus heat is transferred from the first fluid to the second fluid through both of an interior wall running through an axial chamber after the fluid has flowed in first cyclonic flow between an exterior wall spaced from and surrounding an interior wall. Such a configuration significantly increases the heat transfer area between the two fluids and the two cyclonic fluid flows induced around both the exterior wall and the interior wall surfaces during fluid flow therethrough of the heated fluid, and significantly enhances the heat exchange from fluid contact therewith and thereby the transfer of heat to the fluid being heated in the interior tank.

The forgoing examples of related art and limitations related therewith in the area of heat exchangers, are intended to be illustrative and not exclusive, and they do not imply any limitations on the heat exchanger device and method described and claimed herein. Various limitations of the related art are already known or will become apparent to those skilled in the art upon a reading and understanding of the specification below and the accompanying drawings.

SUMMARY OF THE INVENTION

In accordance with the objects of the present invention, as embodied and broadly described herein, the disclosed device provides a unique configuration for a shell and tube type heat exchanger, which is configured an intake conduit and passage directing fluid at an angle and forming a first fluid flow director to induce a first cyclonic flow around an exterior wall surface. Intersecting the first cyclonic flow is a second fluid flow director which induces a second cyclonic fluid flow through an axial wall surface of an interior tank for fluid being heated. The cyclonic flow along two portions of the device significantly increases the heat communicated by thermal conduction through both of two separating wall surfaces, which surround and define an interior tank therebetween. Incoming heated fluid flows thus are able to communicate heat to a secondary fluid within the heating tank, through both of two wall surfaces surrounding the interior and exterior of the tank.

The tank has an interior wall surface surrounds and defines an axial space of a centrally located axial conduit. This interior wall thus forms an axial or center wall of the tank for heating a second fluid surrounding it. Thus heated fluid communicated thereto from the first cyclonic fluid flow in the circumferential passage surrounding the heating tank, heats the axial conduit as it flows through an axial conduit to an exit from the tank.

As noted, the tank for heating a secondary fluid, has an exterior wall formed by a wall surface centered and spaced from and surrounding the axial conduit running through the center of the tank. As such, heat from a heated fluid flowing into the device and around the exterior wall is communicated in first cyclonic flow and through the exterior wall to a colder fluid positioned within the tank. This heat transfer is accomplished by thermal conduction through both the exterior wall surface, and during the exit of the heated fluid from the system, through the interior wall surface spaced from and surrounded by the exterior wall surface formed by the axial conduit.

Both the formed tank for fluid to be heated formed by the interior wall and exterior wall and the axial conduit are positioned within a housing having a sidewall spaced from the exterior wall surface. All are engaged with a first endwall at a first end of the housing adjacent a first end of the tank and a second endwall engaged with the sidewall at a second end of the housing adjacent a second end of the tank.

The circumferential passage is formed in-between the sidewall of the housing and the exterior or second sidewall of the tank for the fluid to be heated. This circumferential passage for the heated fluid ingress is positioned within the housing and is in a sealed fluid communication at one end with the axial passage providing the exit passage for the heating fluid.

Adjacent the first end of the housing, an intake conduit is located which has a passage which communicates at a first end in a sealed engagement with the circumferential passage. The intake conduit extends through the sidewall of the housing and directs fluid flow into the circumferential passage which surrounds a second wall of a tank holding the fluid to be heated. Heated fluid exiting the circumferential passages exits to an axial passage running through a center of the tank and provides secondary heating for the fluid to be heated in the tank before exiting the housing. The heated fluid flow which enters the housing through the intake conduit which is engaged at an angle to the axis of the device to form a first fluid flow director which induces a first cyclonic fluid flow around the exterior wall of the tank surrounding the fluid to be heated. After passage through a second fluid flow director, the heated fluid in a second cyclonic fluid flow exits the housing through the axial passage of an axial conduit.

Thus, fluid circulating through the tank to provide the heat source is communicated into the tank through a conduit which communicates through a sidewall of the tank and then to an exit through the axial conduit. Fluid exiting the tank is communicated by the axial conduit in a sealed engagement with the tank through an endwall of the housing.

The heated fluid flow communicated into the housing through an extension of the intake conduit communicating through a sidewall flows in the dual circular flow induced by a flow directors defined by the angle of the intake conduit and fins in the second fluid flow director located at an opposite end of the housing. The incoming fluid then passes through the first flow director, formed by the intake conduit, around the outside surface of the tank, through the second fluid flow director and, in a second cyclonic fluid flow, exits the housing through the axial conduit which extends through the first endwall. In operation, the intake conduit in the sealed engagement through the sidewall communicates incoming heating fluid which has been heated by a heat source such as an electric source or flame or other conventional heat source, into the housing.

As noted, adjacent the second end of the tank, adjacent the second endwall of the housing, is located the finned second flow director. So positioned, it receives the heated fluid flow circulating in the first cyclonic flow around the sidewall of the tank and reverses the flow toward the first end of the device and through the axial conduit. The initial input of fluid into the circumferential passage along with a plurality of fins engaged with the flow director, both induce and enhance a spinning cyclonic flow in both the area surrounding the second sidewall of the tank and to the fluid exiting the housing.

This spinning or rotating flow is essentially a circular organized laminar flow which circles the second sidewall of the tank, and within the axial passage surrounded by the tank, and induces a contact of the heated fluid for a longer duration of time than would occur without such cyclonic flows.

Experimentation has shown inducing such cyclonic flows significantly increases heat transfer through the second sidewall of the tank and interior wall, thereof, by eliminating conventional turbulent fluid flows which causes a contact of heated fluid with the surfaces of the tank for a longer duration of time.

As such, the inclusion of one or preferably both of a first and a second fluid flow director to induce separate cyclonic fluid flows in contact with at least one and preferably both the first and second walls surrounding the tank for heating fluid is preferred.

In a similar fashion as the intake conduit, the axial conduit provides an exhaust conduit for heated fluid flow along an axial passage from the flow director inducing the rotating fluid flow. Such provides additional thermal contact of the heated fluid and provides an exit passage for fluid which flowed into the tank from the intake conduit.

With respect to the above description, before explaining at least one preferred embodiment of the herein disclosed heat exchanger device in more detail, it is to be understood that the invention is not limited in its application to the details of construction and to the arrangement of the components in the following description or illustrated in the drawings. The heat exchanger herein described and disclosed and depicted in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other dual conductive surface heat exchangers and for carrying out the several purposes of the present disclosed device. It is important, therefore, that the claims be regarded as including such equivalent construction and methodology insofar as they do not depart from the spirit and scope of the present invention.

It is an object of the present invention to provide a heat exchanger with dual heat transferring walls situated on opposite sides of an elongated heating tank to increase heat transfer thereto.

It is another object of the present invention to provide such a heat exchanger device with dual heat conducting walls, which additionally directs fluid flow around an inner wall and a perimeter second wall to increase contact time and heat transfer therethrough.

It is a further object of this invention to induce cyclonic flows to fluid moving through the device, to enhance the area and time of contact of heated fluid with conducting surfaces and thereby enhance heating of the cooler fluid.

These and other objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed device. It is intended that the embodiments and figures disclosed herein are to be considered illustrative of the invention herein, rather than limiting in any fashion.

In the drawings:

FIG. 1 depicts a perspective view of the heat exchanger herein showing the exterior of the housing and showing an axial passage on an intake conduit for input of heating fluid at an angle "A" to form a first fluid flow director which induces a first cyclonic flow and an axial passage running through an exhaust conduit for the exit of heating fluid moving in a second cyclonic flow from an internal tank.

Figure 1:
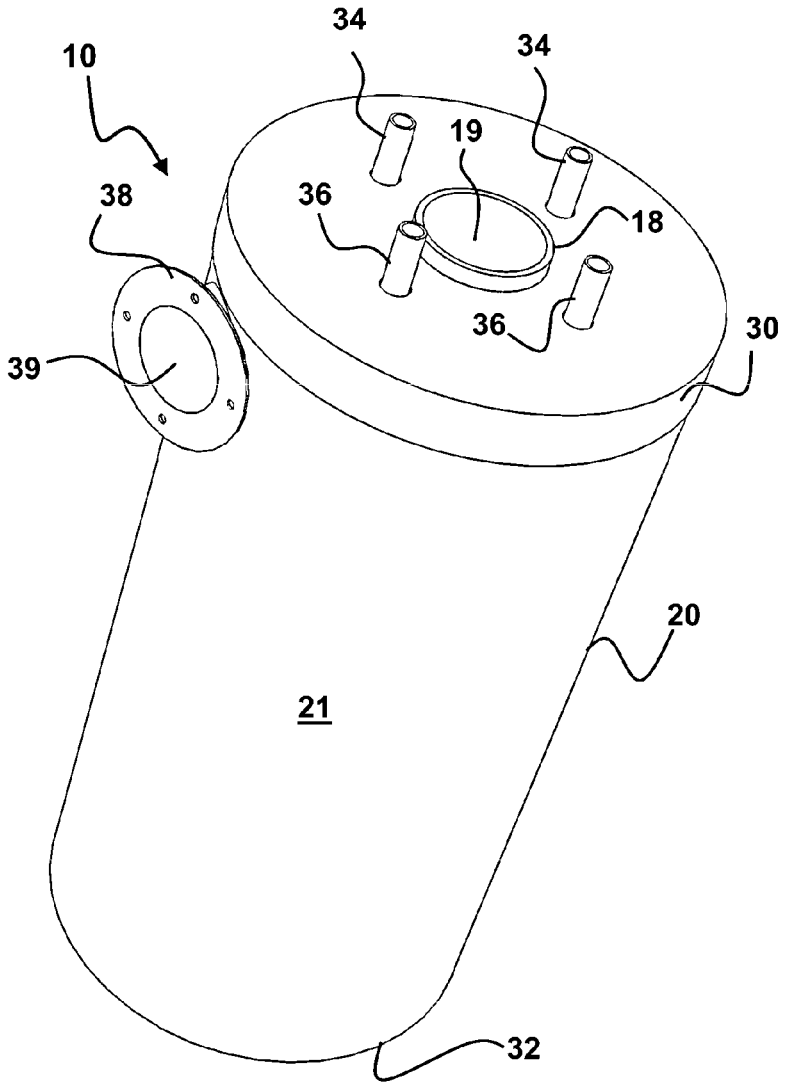
Figure 4:
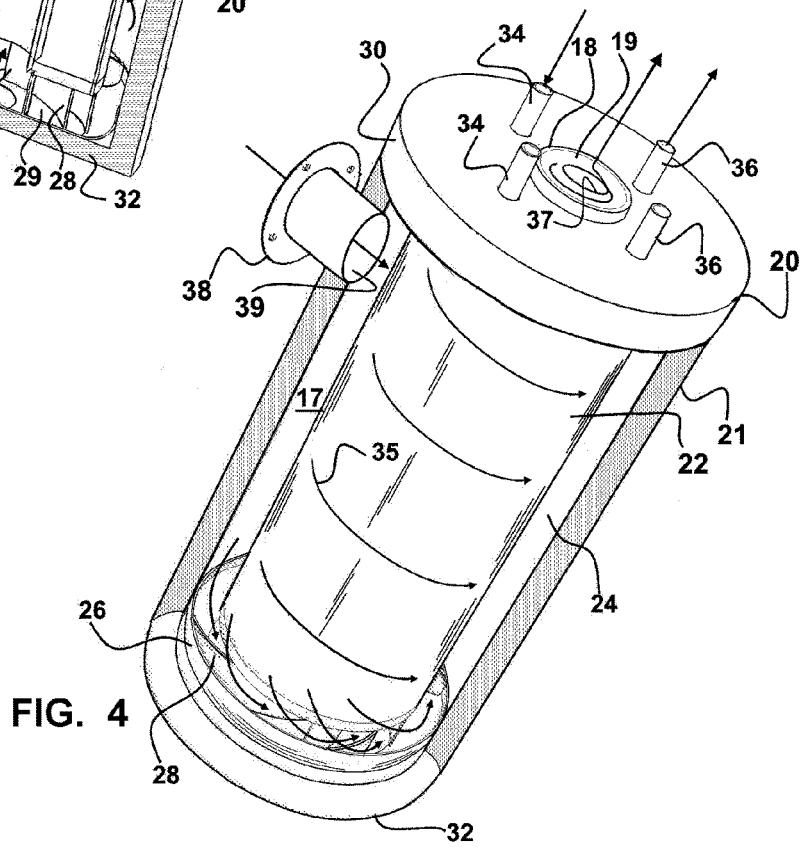

FIG. 4 depicts a view of the heat exchanger of FIG. 1 with a portion of the sidewall of the housing removed to more clearly show the angle of the intake passage inducing the first cyclonic fluid flow which is enhanced by fins of the flow director which intersect the fluid flowing around a second wall of the tank and form a second cyclonic fluid flow through the axial passage running through the exhaust conduit of the tank.

Figure 5:
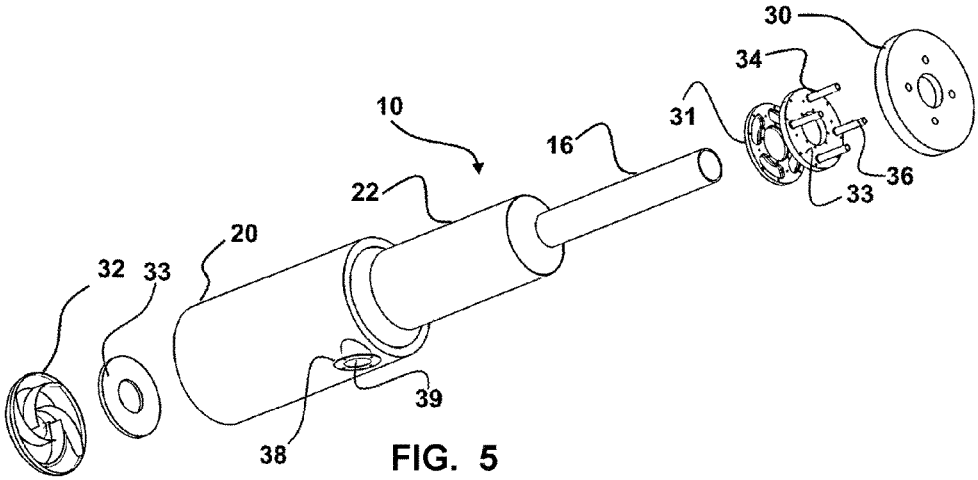

FIG. 5 depicts an exploded view of the device herein.

Figure 6:
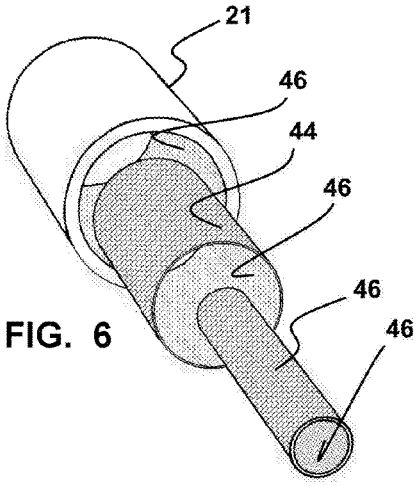

FIG. 6 shows various components of the device in a mode having textured or stippled surfaces much like a golf ball, which increase an area for thermal contact of fluid, and thereby enhance heat transfer from the heated fluid to the fluid being heated by the device herein.

DETAILED DESCRIPTION OF THE INVENTION

Figure 2:
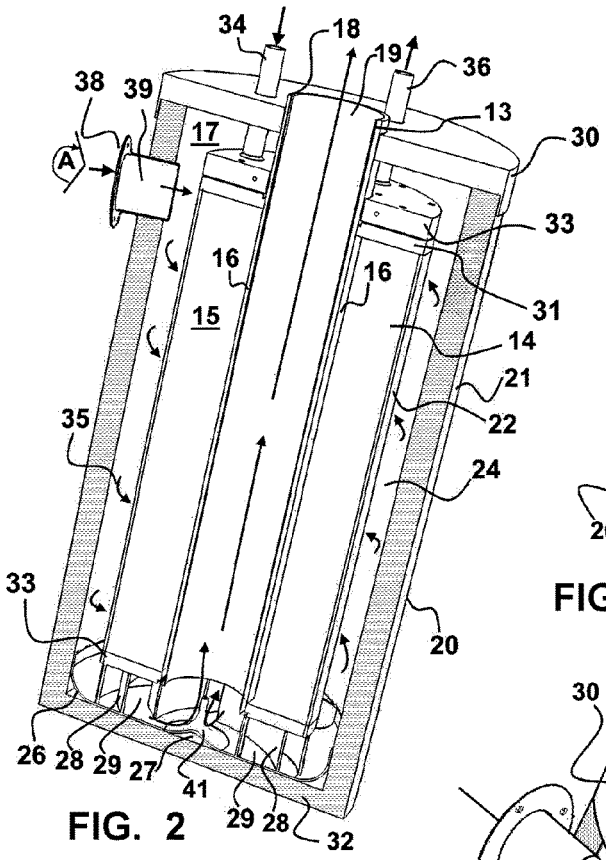
FIG. 2 shows a sectional view through the device of FIG. 1, showing the internal components where an axial conduit flow through the center of a tank receives a second rotating or cyclonic fluid flow from a circumferential passage having a first cyclonic fluid flow, which surrounds the exterior of the tank on an opposite side.

Now referring to drawings in FIGS. 1-6, wherein similar components are identified by like reference numerals, there is seen in FIG. 1, an exterior perspective view of the device 10 and in FIG. 2 a sectional view.

As shown in FIGS. 1-2, the housing 20 has a sidewall 21 which is in a sealed engagement at a first end of the housing located at a first endwall 30 situated adjacent a sealing plate 33 for a first end of the tank 14, through which intake conduits 34 pass, which is adjacent an inspection plate 31. At a second end of the housing 20 the sidewall 21 seals with a second endwall 32 situated adjacent a donut-shaped sealing plate 33 which seals the second end of the tank 14 and sealing a tank cavity 15 within the tank 14. The housing 20 has an interior cavity 17 located in between the sidewall 21 and the first endwall 30 and the second endwall 32.

Fluid flow of the fluid to be heated into the tank cavity 15 of the tank 14 to which heat is communicated is provided through at least one intake conduit 34 which passes in a sealed engagement through the sealing plate 33 and into the tank cavity 15 adjacent the first endwall 30 and which forms a sealed connection with the first end of the tank 14. Also shown are at least one output conduit 36 which is in a sealed engagement through the sealing plate 33 and into fluid engagement with the tank cavity 15 adjacent the first end of the tank 14. Both the intake conduits 34 and output conduits 36 pass through the first endwall 30. The output conduits 36, as shown, provide an exit passage for heated fluid from the tank cavity 15 of the tank 14.

Additionally depicted in FIG. 1, and better shown in FIGS. 2 and 4, are the exhaust conduit 18 having an axial passage 19 surrounded by the conduit wall 13 of the exhaust conduit 18. This exhaust conduit 18 communicates through the opening in the inspection plate 31 and the sealing plate 33 and the first sidewall 30. The exhaust conduit 18 runs axially through the tank 14 inside the interior cavity 17 of the housing 20 as shown in FIG. 2. The conduit wall 13 forming the exhaust conduit 18 can be separate and in direct contact with the first wall 16 running axially through the tank 14, or it can form the first wall 16 of the tank 14. Forming the conduit wall 13 of the exhaust conduit 18, separate from the first wall 16, allows the tank 14 to be easily engaged and disengaged from the housing for maintenance. However, forming the conduit wall 13 as the first wall 16 may transfer heat better to fluid within the tank cavity 15.

Further shown in FIG. 1, and as seen in FIGS. 2 and 4, the exhaust conduit 18 having an axial passage 19 running therein provides the exit for incoming fluid from the intake conduit 38. In all modes of the device 10, and as seen in FIG. 2 and FIG. 4, the exhaust conduit 18 passes through the first endwall 30 of the housing 20, and the axial passage 19 is in a sealed fluid engagement with the circumferential passage 24 positioned in-between the sidewall 21 and the second wall 22 of the tank 14. This circumferential passage 24 formed within the interior cavity 17, surrounds the second wall 22 of the tank 14 and extends from the first end to the second end of the housing 20.

As best shown in FIG. 2, the surface of the first wall 16 of the tank 14, which, as noted, may also be formed by the exhaust wall 13 of the exhaust conduit 18 which surrounds the exhausting axial passage 19. If formed as part of the tank 14, the formed surface of the first wall 16, which is shown separate, may be provided by the exhaust wall 13 of the exhaust conduit 18, which can be seen in this mode in FIG. 2. This first wall 16 surrounds the exhaust conduit 18 to receive heat therefrom which is communicated through the first wall 16 from the exhaust wall 13 to the tank cavity 15 and any fluid therein within the tank 14.

The tank 14 as shown in FIG. 2 and FIG. 4, has a second wall surface of the second wall 22 which is spaced from and surrounds the first wall 16 which contacts or is formed by the exhaust conduit 18 running axially through the center of the tank 14. In this configuration, heat from a fluid flowing into the axial passage 19 of the exhaust conduit 18 is communicated to any fluid positioned within the tank 14, by thermal conduction through both the surface of the first wall 16, and the surface of the second wall 22 of the tank 14 which is spaced from and circumferentially surrounds the surface of the first wall 16.

The first wall 16 and the second wall 22 are formed of a metal adapted to pass heat by thermal conduction therethrough so heat from the heated fluid flow running into the housing 20 from the intake passage 39 of the intake conduit 38, and to and along the axial passage 19 running through the exhaust conduit 18, is communicated into the fluid located in or flowing through the tank 14 from two opposing sides.

As can be seen in FIGS. 2 and 4, for example, the direction of the axis and force of fluid input through the intake passage 39 along angle "A", is running in a line at an angle "A", which is in a direction substantially normal to the surface of the second wall 22 which essentially runs parallel to the first wall 16. By substantially normal is meant the angle "A", is between 45 degrees to 135 degrees approaching the second wall 22 surface. Further, an angle of substantially 90 degrees is especially preferred by which is meant between 85-95 degrees along a line approaching the planar second wall 22 surface.

Experimentation has shown that fluid incoming along the axis of the intake passage 39, at an angle substantially normal or substantially 90 degrees approaching the plane of the second wall 22, forms a first fluid flow director from the intake conduit 38 which induces a first cyclonic fluid flow 35 into the fluid around the second wall 22. Thus, positioning intake conduit 38 to position intake passage 39 having an angle "A", at substantially 90 degrees or substantially normal to the planar surface of the second wall 22 to which it approaches, is preferred to form the intake conduit 38 and intake passage 39 in a preferred mode to form a first flow director to induce the first cyclonic fluid flow 35 around the circumferential passage 24 in a direction toward the second sidewall 32.

As noted, both the formed tank 14 and the exhaust conduit 18 are positioned within the housing 20 which has a size or volume defined by the area within the first wall 16 and sidewall 21 thereof. This sidewall 21 is sealably engaged with the sealing plate 33 and, if present, an inspection plate 31 adjacent the first endwall 30 at a first end of the housing 20 adjacent a first end of the tank 14. Another sealing plate 33 adjacent the second endwall 32 is in sealed engagement with the sidewall 21 adjacent the second end of the housing 20 adjacent a second end of the tank 14.

The circumferential passage 24 surrounds and is located in between the sidewall 21 of the housing 20 and the second wall 22 of the tank 14. This circumferential passage 24 receives a heated fluid flowing from the intake passage 39 of the intake conduit 38, which then flows to an exhaust from the axial passage 19 which is in communication with the circumferential passage 24 adjacent the second end of the tank 14 which is proximate to the second endwall 32. The first end of the circumferential passage 24 seals with the first endwall 30 and the second end of the circumferential passage 24 seals with the second endwall 32 and/or the circumference of the second flow director 26.

In this configuration, cooler fluid circulating through the tank 14 enters the tank 14 within the housing 20 through at least one intake conduit 34 which communicates through the first endwall 30 and which is in a sealed connection with the tank 14. Heated fluid exiting the tank 14 follows an exiting fluid flow through at least one output conduit 36 which is also in sealed engagement into the tank 14, and which is shown passing through the first endwall 30 of the housing 20. Of course both the intake conduits 34 and the output conduits 36, can pass through the sidewall 20 to engagement with the tank 14. However, such would pass through the circumferential passage 24 and not be optimal as it might interrupt the fluid flow and would lessen the area of the second wall 22.

In operation, the heated fluid flow is communicated into the housing through the intake passage 39 of the intake conduit 38. This intake passage 39 is in communication with a fluid heat source which provides the heated fluid flow into the intake passage 39 of the intake conduit 38 and then to the circumferential passage 24.

Figure 3:
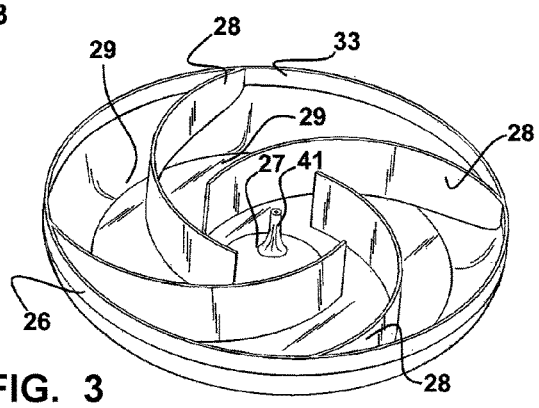
FIG. 3 shows the second fluid flow director which is positionable adjacent a second end of the housing in sealed engagement with the circumferential passage and with the axial conduit of an exhaust passage, which enhances the first cyclonic fluid flow in the circumferential passage and induces a second cyclonic fluid flow in the axial conduit for fluid exiting the housing.

As shown in FIG. 2 and FIG. 4, the second end of the tank adjacent the second endwall 32 of the housing 20 is located the second flow director 26 which is shown enlarged in FIG. 3. The second flow director 26 may be part of the second endwall 32 or as shown may be a separate component located adjacent the second endwall 32 at the second end of the tank 14. The second flow director 26, so positioned at a central area 27 of the housing 20 with a central area 27 aligned with the axial passage 19, receives the heated fluid flow exiting from the circumferential passage 24 adjacent the second end of the housing 20.

As can be seen in FIG. 3, in a preferred mode of the device 10, the second flow director 26 includes a plurality of curved fins 28 engaged with the second flow director 26 in a radial arrangement around the central area 27 wherein a cone 41 may be located. This cone 41 is optional but has shown in experimentation to more evenly reflect and direct the fluid stream from to the axial passage 19 from the curved radially oriented channels 29 between the fins 28 which direct fluid flowing from the circumferential passage 24.

In this configuration, fluid entering the second flow director 26 from the circumferential passage 24, which already has an induced cyclonic flow, is directed inward through curved channels 29 located in between the radially oriented fins 28 toward a central area 27 which is in fluid communication with the axial passage 19. This curved flow direction of fluid to the axial passage 19 through and from the curved channels 29 of the second flow director 26, induces the second cyclonic fluid flow 37 and channels the incoming fluid flow from the circumferential passage 24, inward and into the second cyclonic fluid flow 37 within the axial passage 19. This as such, reverses and forms this second cyclonic fluid flow 37 running axially through the axial passage 19 toward the first endwall 30 which as noted is at the first end of the housing 20.

This channeling along the radially disposed channels 29 in experimentation was found to also enhance the first cyclonic fluid flow 35 shown in FIG. 4, which as noted, is first initiated by the force and angle of fluid direction of the fluid entering the intake conduit 38. Thus, the first cyclonic fluid flow 35 is enhanced in the fluid coming from the circumferential passage 24, and a second cyclonic fluid flow 37 is imparted to the fluid exiting the circumferential passage 24 into the axial passage 19 of the exhaust conduit 18 toward the first end of the housing 20.

The rotating or first cyclonic flow 35 and second cyclonic fluid flow 37, both move substantially a circular organized laminar fluid flow, where the heated fluid within the circumferential passage 24 flows in repeating circles around, and in contact with, the second wall 22 of the tank and also through and in contact with the walls of the exhaust conduit 18. This induced first cyclonic fluid flow 35 from the direction of the incoming fluid through the intake conduit 38 which is enhanced by flow through the channels 29 defined by the fins 28, and the second cyclonic fluid flow 37 induced by the channels, thus causes the heated fluid from the intake conduit 38, during travel through the housing to an exhaust of fluid from the axial passage 19, to contact the second wall 22 of the tank 14, as well as the exhaust conduit 18, for a longer duration of time. The first and second cyclonic fluid flows also induce fluid contact over a greater area of the second wall 22 and exhaust conduit 18, than occurs in a conventional heat exchanger which has a turbulent fluid flow surrounding a wall of a tank 14.

To that end, experimentation has shown inducing such a first cyclonic fluid flow 35 and a second cyclonic fluid flow 37, significantly increases heat transfer from the heated fluid communicated from the intake conduit 38 into the circumferential passage 24 and onto the axial passage 19, with both the first wall 16 and the second sidewall 22 of the tank 14 by conduction of heat over a larger area and for a longer time period, into the colder fluid within the tank 14.

The inclusion of the first wall 16 and the second wall 22 on both sides of the tank 14 for the fluid to be heated, will form a device 10 which enhances the heat transfer to fluid in the tank 14 without the fins 28 engaged with the second flow director 26, and as such, the device 10 may be configured in one preferred mode with the second flow director 26 formed without the fins 28 or a cone 41 and yield a substantial gain in performance.

However, because of the gain in heat transfer provided by the first cyclonic fluid flow 35 and second cyclonic fluid flow 37, an even more preferred mode of the device 10 includes both the first wall 16 surrounding the axial passage 19 and thereby communicating heat to the interior circumference of the tank 14, and the second wall 22 surrounding the exterior circumference of the tank 14, and thereby communicating heat thereto from a second side. Such is also preferred to employ the second flow director 26 which includes the fins 28 and optionally the cone 41, having curved radial channels 29, to enhance the induced rotating cyclonic flow 35 shown in FIG. 4. This flow may be in either a right-hand rotation or left-hand rotation and such is dependent on the direction of entry of the intake conduit 38 and the curved path of the fins 28 defining the channels 29.

Adjacent the first end of the housing 20 which is capped by the first endwall 30, the intake conduit 38 is located which has an intake passage 39 which is in a sealed communication at a first end with the circumferential passage 24. The intake conduit 38 extends through the sidewall 21 of the housing 20 and positions the entry of the intake passage 39 outside the housing 20. The intake conduit 38 might also extend through the first endwall 30 or second endwall 32 to the sealed engagement with the circumferential passage 24.

The heated fluid flow in operation of the device 10 thus follows a heated fluid flow path entering the housing 20 through the intake conduit 38 and in a first rotating or cyclonic flow through the circumferential passage 24, and then curving at the second flow director 26, to second cyclonic or rotating fluid flow within the axial passage 19 to an exit at the exhaust conduit 18 which communicates through the first endwall 30. This rotating fluid flow around both the surface of the second wall 22 and the first wall 16, as noted, thereby causes a longer duration of contact of heated fluid with those surfaces and an enhanced communication of heat through both of the two surfaces into a fluid being heated within the tank 14.

As noted, in FIG. 5 is shown an exploded view of the components noted herein and in FIG. 6 is shown an optional configuration of components which enhances heat transfer using a stippled or dimpled configuration of heat transferring surfaces of the device 10. As shown FIG. 6, one or a plurality of surfaces may be formed with stippled surfaces 46 which essentially forms dimples into the component surfaces to increase and thereby enhance an area for heat transference.

As shown in FIG. 6, such stippled surfaces 46 may be formed on one or more of the interior of the exhaust conduit 18, the exterior of the exhaust conduit 18 which would form the interior of the tank 14 if formed as one piece, an interior surface of the tank 14, the exterior of the second wall 22 which forms the tank 14 where it communicates with the circumferential passage 24, or the interior surface of the housing 20 where it communicates with the circumferential passage 24.

It should be noted, that while the present invention has been described herein with reference to particular embodiments thereof and operation thereof, a latitude of modifications, various changes and substitutions are intended in the foregoing disclosures, it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A heat exchanger, comprising:

a housing having a sidewall surrounding an interior cavity extending between a first end of said housing to a second end of said housing;

an exhaust conduit running axially within said interior cavity, said exhaust conduit having a conduit wall surrounding an axial passage, said conduit wall extending from a first end of said exhaust conduit adjacent said second end of said housing, to a second end of said exhaust conduit extending through said first sidewall;

a tank positioned within said interior cavity, said tank having a tank cavity which is positioned between a first wall of said tank and a second wall of said tank surrounding said first wall;

a circumferential passage positioned in said interior cavity of said housing between a surface of said second wall of said tank and said sidewall of said housing;

an intake conduit communicating through said sidewall, said intake conduit having an intake passage and defining a first flow director for communicating a first fluid into said circumferential passage in a first fluid flow;

a second flow director positioned within said interior cavity adjacent said second end of said housing;

said second flow director having a plurality of channels, said channels directing said first fluid flow of said first fluid from said interior cavity into a second fluid flow into and through said axial passage of said exhaust conduit;

an intake conduit in a sealed connection at a first end with said tank cavity and extending through said first end of said housing to a second end, said intake conduit defining a path for a flow of a second fluid into said tank cavity;

an output conduit having a first end in sealed engagement with said tank cavity, said output conduit extending through said first end of said housing to a second end, said output conduit defining a path for a flow of said second fluid out of said tank cavity; and whereby heat from said first fluid in said first flow through said circumferential passage is communicated to said second wall of said tank, and said heat from said first fluid in said second fluid flow is communicated to said first wall of said tank, thereby heating said second fluid within said tank cavity from opposing sides thereof.

2. The heat exchanger of claim 1, additionally comprising:

said first flow director inducing a first cyclonic fluid flow to said first fluid passing therethrough, said first cyclonic fluid inducing a circular flow of said first fluid within said circumferential passage and around said second wall of said tank in a direction toward said second end of said housing; and whereby said first cyclonic fluid flow increases a time of contact of said first fluid with said second wall of said tank.

3. The heat exchanger of claim 1, additionally comprising:

said channels of said flow director being positioned between a plurality of curved fins;

said curved fins inducing a second cyclonic fluid flow to said first fluid in said second fluid flow, said second cyclonic fluid flowing in a circular flow within said axial passage in a direction toward said second end of said exhaust conduit; and whereby said second cyclonic fluid flow increases a time of contact of said first fluid with said conduit wall surrounding said axial passage thereby enhancing a communication of heat from said first fluid to said first wall of said tank.

4. The heat exchanger of claim 2, additionally comprising:

said channels of said flow director being positioned between a plurality of curved fins;

said curved fins inducing a second cyclonic fluid flow to said first fluid in said second fluid flow, said second cyclonic fluid flowing in a circular flow within said axial passage in a direction toward said second end of said exhaust conduit; and whereby said second cyclonic fluid flow increases a time of contact of said first fluid with said conduit wall surrounding said axial passage thereby enhancing a communication of heat from said first fluid to said first wall of said tank.

5. The heat exchanger of claim 1, additionally comprising:

said conduit wall forming said first wall of said tank.

6. The heat exchanger of claim 2, additionally comprising:

said conduit wall forming said first wall of said tank.

7. The heat exchanger of claim 3, additionally comprising:

said conduit wall forming said first wall of said tank.

8. The heat exchanger of claim 1, additionally comprising:

said intake conduit communicating through said sidewall at an angle substantially normal to said surface of said second wall of said tank.

9. The heat exchanger of claim 2, additionally comprising:

said intake conduit communicating through said sidewall at an angle substantially normal to said surface of said second wall of said tank.

10. The heat exchanger of claim 4, additionally comprising:

said intake conduit communicating through said sidewall at an angle substantially normal to said surface of said second wall of said tank.

11. The heat exchanger of claim 1, additionally comprising:

said intake conduit communicating through said sidewall at an angle between 45 degrees to 135 degrees to said surface of said second wall of said tank.

12. The heat exchanger of claim 2, additionally comprising:

said intake conduit communicating through said sidewall at an angle between 45 degrees to 135 degrees to said surface of said second wall of said tank.

13. The heat exchanger of claim 4, additionally comprising:

said intake conduit communicating through said sidewall at an angle between 45 degrees to 135 degrees to said surface of said second wall of said tank.

14. The heat exchanger of claim 1, additionally comprising:

said second wall of said tank having a stippled surface.

15. The heat exchanger of claim 1, additionally comprising:

said first wall of said tank having a stippled surface.

16. The heat exchanger of claim 14, additionally comprising:

said first wall of said tank having a stippled surface.

* * * * *